United States Patent [19]

Burke

[11] 4,345,691

[45] Aug. 24, 1982

[54] CHILD RESISTANT BOTTLE CLOSURE

[75] Inventor: James E. Burke, Huntington, Conn.

[73] Assignee: Ethyl Products Company, Richmond, Va.

[21] Appl. No.: 176,398

[22] Filed: Aug. 8, 1980

Related U.S. Application Data

[63] Continuation of Ser. No. 34,584, Apr. 30, 1979, abandoned.

[51] Int. Cl.[3] ..... B65D 55/02

[52] U.S. Cl. ..... 215/216; 215/274; 215/276; 215/330; 222/153; 222/383

[58] Field of Search ..... 215/216, 274, 276, 330; 222/153, 383, 384, 385; 239/333

[56] References Cited

U.S. PATENT DOCUMENTS

| | | | |
|---|---|---|---|
| 3,650,473 | 3/1972 | Malone | 222/383 X |
| 3,795,337 | 3/1974 | Nozawa et al. | 215/220 |
| 4,065,037 | 12/1977 | Haller | 222/153 |

*Primary Examiner*—George T. Hall

*Attorney, Agent, or Firm*—Donald L. Johnson; John F. Sieberth

[57] ABSTRACT

A child resistant closure for a container having a pump or other dispensing device connected to the container including a cap having a hole in the top for receipt of the pump or dispensing device and threads on the inside walls for engaging threads located on the container, the cap having a series of ratchet teeth on the inside wall for engaging a series of ratchet teeth on the bottle to prevent the cap from being removed from the container.

4 Claims, 7 Drawing Figures

CHILD RESISTANT BOTTLE CLOSURE

This is a continuation of application Ser. No. 34,584, filed Apr. 30, 1979, now abandoned.

BACKGROUND OF THE INVENTION

This invention relates to closures or caps for fluid dispensers having pumps or dispensing devices connected thereto, and more particularly to such caps which are mounted or secured in place by means of screw threads. Even more particularly, the present invention relates to a cap for connecting a pump or other dispensing device to a fluid container which prevents the pump or dispensing device from being removed from the container.

Dispensing containers of the hand-held variety, for example aerosol spray pump types, are used quite commonly for packaging and dispensing a multiplicity of products. Many of the products dispensed could cause harm to uninformed users such as children. Products dispensed may include paint, lacquers, oils, hair sprays, insecticides, cleansers, paint removers, oven cleaners, etc. Obviously, due to the hazardous nature of such materials, unauthorized utilization of such should be prevented.

Fortunately, there are many so-called "child resistant" devices presently on the market to prevent dispensing of harmful products by children. However, most of these devices rely upon either the difference of strength or manual coordination between an adult and a child.

Most of the closures of the prior art must be removed so that the contents may be dispensed. See for example U.S. Pat. Nos. 3,912,101 and 3,795,337. None of these devices disclose means for connecting a pump or dispensing device to the container so that the pump may not be removed from the container by unscrewing of the cap.

It is therefore an object of the invention to provide a child resistant cap which may be utilized on dispensing containers for connecting dispensing devices such as finger pumps to the containers which is highly child resistant.

THE INVENTION

In accordance with the present invention there is provided a child resistant closure for a container having a pump or other dispensing device connected to the container including a cap having a hole in the top for receipt of the pump or dispensing device and threads on the inside walls for engaging threads located on the container, the cap having a series of ratchet teeth on the inside wall for engaging a series of ratchet teeth on the bottle to prevent the cap and pump contained therein from being removed from the container.

DESCRIPTION OF THE PREFERRED EMBODIMENTS

Figure 7:
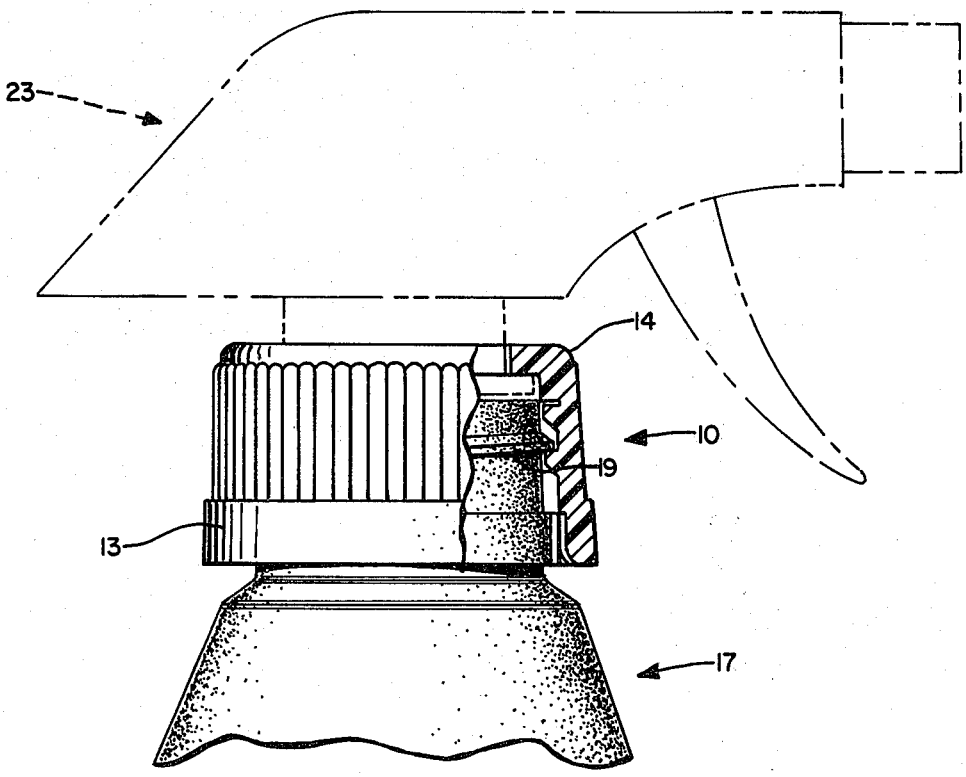

As shown in the drawings, and particularly in FIG. 7, the actual assembly includes the dispensing pump assemblage which is intended to be removably mounted on a container of the type having a threaded neck. The dispensing device or pump is generally indicated by the numeral 23 and can be any conventional dispensing pump such as that shown in U.S. Pat. No. 3,650,473, for example.

Figure 1:
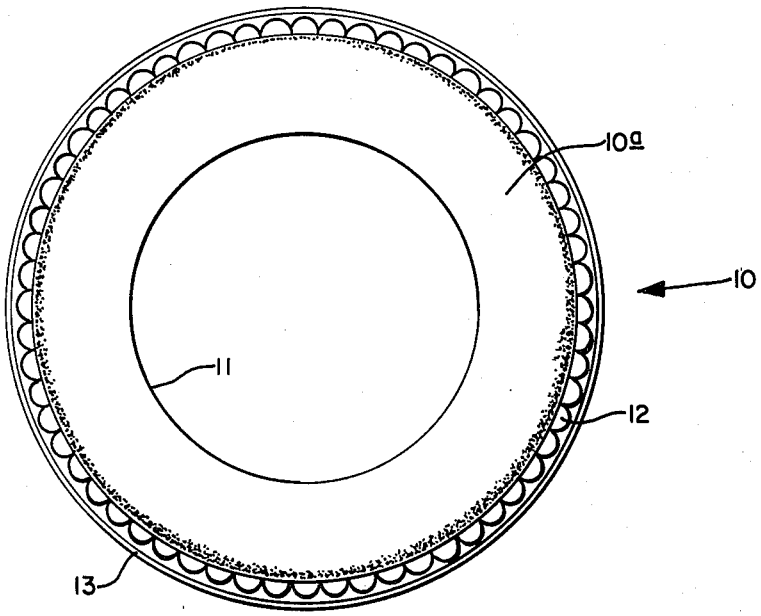
FIG. 1 is a top plan view of the cap of the present invention.

In FIG. 1 is shown the cap of the present invention, generally indicated by the numeral 10. Cap 10 can be seen to have a circular hole 11 in the top 10*a* thereof for receipt of the pump or other dispensing device.

Figure 2:
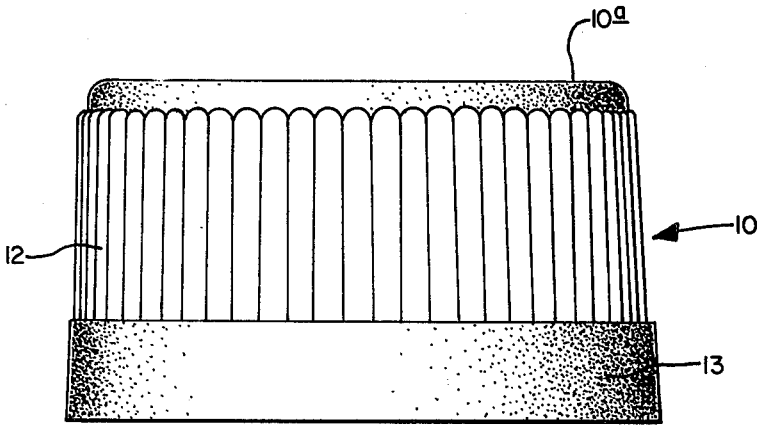
FIG. 2 is a side elevational view of the cap of the present invention.

As seen in FIGS. 1 and 2, on the outside of cap 10 are a plurality of protuberances 12 which are grasped by the fingers of the user when screwing the cap onto the container. At the bottom of the cap is a ridge 13 which provides added strength to the closure. Both protuberances 12 and ridge 13 could be deleted if desired.

Figure 3:
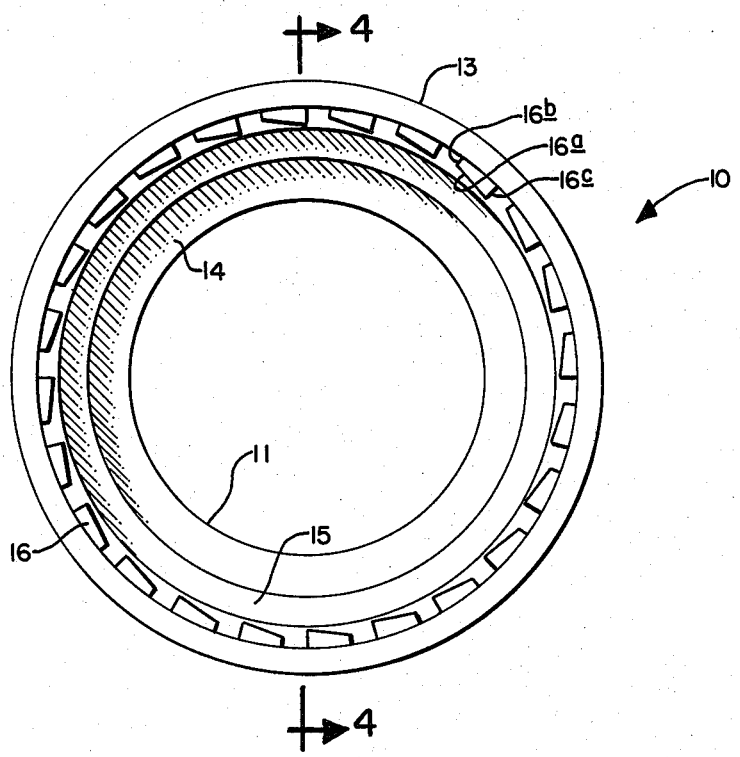
FIG. 3 is a bottom plan view of the cap of the present invention.
Figure 4:
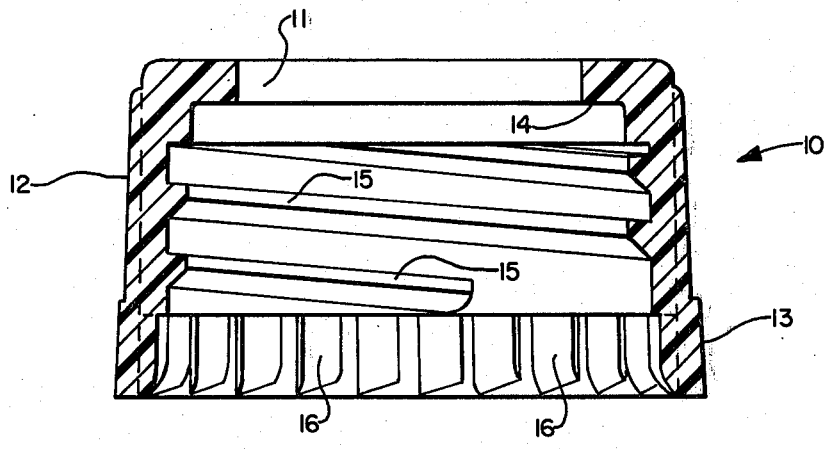
FIG. 4 is a cross-sectional view taken along lines 4—4 of FIG. 3.

As can be seen more clearly in FIGS. 3 and 4, the interior of cap 10 contains threads 15 and at the very bottom thereof a series of beveled ratchet teeth 16. Ratchet teeth 16 have beveled edges 16*a* and front and rear edges 16*b* and 16*c*, respectively, which may be formed approximately tangentially to ridge 13.

As can be seen in FIG. 3, the front edges 16*b* are smaller than the rear edges 16*c*. Around the edge of hole 11 is located rim 14. Rim 14 can be used to engage a flange on the pump mechanism as shown in the previously cited U.S. Pat. No. 3,650,473.

Figure 5:
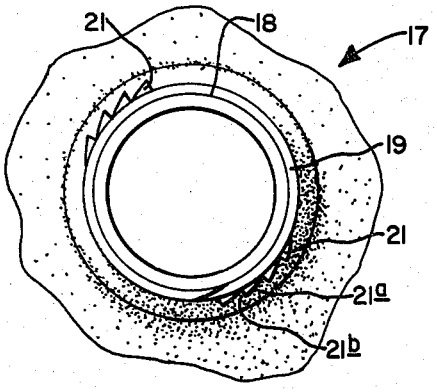
FIG. 5 is a partly cut-away top view of the container and container top of the present invention.
Figure 6:
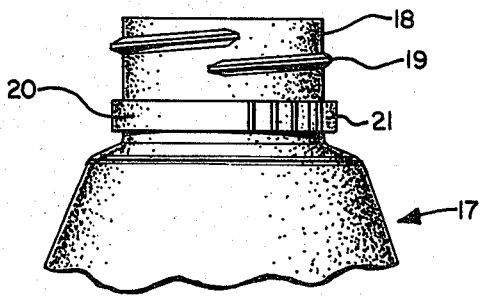
FIG. 6 is a side elevational, partly cut-away view of the container and container top of the present invention; and, FIG. 7 is a partly sectional, side elevational view of the cap of the invention connected to the container of the invention with the dispensing device held by the cap to the container.

As seen in FIGS. 5, 6, and 7, the container of the present invention is indicated generally by the numeral 17. Container 17 has a vertical top 18 containing threads 19 which engages threaded cap 10. Beneath thread 19 of container 17 is located a ridge 20 integrally formed with container 17 which contains a plurality of ratchet teeth 21 on the outer edge thereof. Ratchet teeth 21 have beveled surfaces 21*a* and a rear edge 21*b* which is approximately tangential to the circular ridge 20 on container 17.

In FIG. 7 the container and closuer of the present invention are shown assembled to contain a typical pump 23. Pump 23 is received in hole 22 shown in FIG. 5 of container 17.

The ratchet teeth 21 on container 17 engage ratchet teeth 16 on cap 10 after cap 10 reaches a certain point as it is being threaded downward onto container 17. The ratchet teeth 21 and 16 easily slide over each other when the cap is turned in the direction necessary to thread the cap onto the container. However, the ratchet teeth prevent the cap from being unscrewed from the container, thus holding the pump 23 firmly onto container 17.

Having fully described the preferred embodiments of the present invention, it is desired that it be limited only within the spirit and scope of the following claims.

What is claimed:

1. A child-resistant closure assembly for connecting a pump or other dispensing device to a container comprising a cap and a fluid container, said cap having a circular outer ridge means, said cap and said container having a series of ratchet teeth thereon for mutual engagement to prevent said cap from being removed from said container when said cap is threaded onto said container, said ratchet teeth being spaced apart on said cap, said teeth on said cap having front and rear edges formed perpendicular to the tangent of said outer ridge and a beveled inner edge, said teeth on said container having generally rectangular, beveled outer surfaces and a rear edge perpendicular to the tangent of said outer ridge, the lower end of said teeth on said container merging into said container, said cap and said container having threads thereon for mutual engagement, said cap having a hole in the top thereof for receiving and connecting a pump or dispensing device to said container.

2. The closure assembly of claim 1 wherein said ratchet teeth on said cap are located on the inside of said cap beneath said threads contained in said cap.

3. The closure assembly of claim 1 wherein said ratchet teeth located on said container are located beneath said threads on said container.

4. The closure assembly of claim 3 wherein said hole in the top of said cap contains a lip therearound for contacting and holding said pump or dispensing device onto said container.

* * * * *